United States Patent [19]

Dorman et al.

[11] Patent Number: 4,721,134

[45] Date of Patent: Jan. 26, 1988

[54] TERRY LOOP RATIO CONTROL DEVICE

[75] Inventors: Martin C. Dorman, Opelika; James F. Byrd, Auburn; Earl Whaley, La Fayette, all of Ala.

[73] Assignee: West Point Pepperell, Inc., West Point, Ga.

[21] Appl. No.: 892,822

[22] Filed: Aug. 4, 1986

[51] Int. Cl.[4] ..... D03D 39/22

[52] U.S. Cl. ..... 139/25; 139/102

[58] Field of Search ..... 139/24, 25, 26, 105, 139/109, 102, 110; 242/75.5, 25, 45; 66/209, 210, 211, 212

[56] References Cited

U.S. PATENT DOCUMENTS 3,871,419 3/1975 Pfarrwaller ..... 139/25

4,122,873 10/1978 Pfarrwaller et al. ..... 139/110

4,293,006 10/1981 Peter ..... 139/25

4,569,373 2/1986 Vogel ..... 139/26

4,585,037 4/1986 Kimbara ..... 139/110

*Primary Examiner*—Henry S. Jaudon

*Attorney, Agent, or Firm*—Cushman, Darby & Cushman

[57] ABSTRACT

The pile-to-ground warp yarn ratio of terry cloth is controlled during the weaving operation by sensing both the tension imposed on the pile warp and the amount of pile warp yarn dispensed from its supply beam. The sensed information is used to control the speed of a pile warp let-off motor which dispenses the pile warp yarn from its beam. Additionally, the sensed information is employed to selectively alter the displacement of a rocking bar to vary the height of the terry loop formed in the cloth.

6 Claims, 2 Drawing Figures

TERRY LOOP RATIO CONTROL DEVICE

BACKGROUND OF THE INVENTION

The present invention relates to the manufacture of terry cloth and, in particular, to apparatus for achieving a uniform ratio of pile to the ground warp which constitutes the fabric's foundation.

For many years terry cloth was produced utilizing conventional fly shuttle looms. Such looms weave a product with a uniform pile-to-ground warp ratio, but they typically operate at a relatively slow rate. More recently, however, fly shuttle looms have been replaced with high speed weaving machines such as the Models PU and TW 11 looms produced by Sulzer Brothers Limited of Winterthur, Switzerland. Various aspects of these types of machines are the subject of several publications, including U.S. Pat. Nos. 3,871,419, 4,122,873 and 4,569,373.

In a Sulzer machine, ground and pile warps move past a reciprocally operable reed and a displaceable rocking bar. The ground warp continuously is dispensed from its supply beam, while the pile warp is dispensed incrementally from its supply beam under the control of a pile warp let-off motor. A weft or filling yarn is inserted between the reed and the movable rocking bar in the weaving operation, and as the reed are displaced towards the rocking bar during their reciprocation, the filling yarn is carried by the reed to the fell of the cloth being woven.

In a typical weaving cycle, the rocking bar is maintained at a first position as the filling yarn is carried to the fell twice in succession in the manner just described. Before the reeds are displaced a third time, however, the pile warp let-off motor dispenses pile yarn, and the rocking bar is displaced to move the fell of the cloth towards the reeds. As a result, when the reed carries the filling yarn to the fell of the cloth, loops of the pile yarn are formed in a row across the top and bottom of the base fabric. The rocking bar then is withdrawn to its initial position to permit the three-pick weaving cycle just described to be repeated.

The height of the loops in terry cloth is very important to its acceptability. In a typical high pile terry, approximately 55% of the total fabric is pile yarn. Any fluctuation in pile height (i.e., a change in the pile-to-ground warp ratio) has an adverse effect on the fabric's weight and appearance.

Two kinds of pile warp let-off can be used in a terrying operation. The first is a positive type pile let-off, a mechanically-linked device which lets-off a predetermined amount of terry yarn based on a mechanical adjustment. The second type—employed in a Sulzer machine—is a negative pile let-off motor which controls let-off in dependency on pile warp tension, the amount of terry yarn dispensed being that required to maintain constant tension on the pile warp.

Terry looms with a motorized negative-type let-off attempt to control the pile-to-warp yarn ratio by monitoring the tension of pile yarn at a location near its supply beam. More particularly in one known version of a Sulzer machine, the ends of pile yarn pass over a flexible beam as they are fed into the loom. A metallic flag is secured to the beam so as to move towards or away from the pile yarn supply beam as the beam flexes in response to the amount of tension applied to the pile warp ends. A proximity sensor is mounted adjacent the flag. This sensor produces an output voltage having a magnitude dependent on the distance between it and the flag. As tension on the pile warp ends changes, the flag's movement alters the sensor's output voltage. This output voltage is supplied to circuitry for producing signals for increasing or decreasing the speed of the pile warp let-off motor to alter the amount of pile yarn dispensed from its supply beam thus maintaining constant tension on the yarn. As the pile warp tension increases, the pile warp let-off motor accelerates so as to decrease the tension. Conversely, a lowering of pile warp tension results in the pile warp let-off motor being slowed in order that the pile warp tension will increase.

An arrangement analogous to that just described for controlling pile warp tension is described in the aforesaid U.S. Pat. No. 4,569,373.

While the arrangements just described contribute to the control of the pile-to-ground warp ratio by maintaining the tension of the pile warp within a normal operating range, the terry height nevertheless still can vary by an unacceptable amount.

SUMMARY OF THE INVENTION

The present invention results from the recognition that a pile-to-ground warp ratio can be maintained substantially uniform by controlling not only the pile warp tension, but also the distance the rocking bar moves during the weaving operation. Since adjustment of the amount of rocking bar displacement in a terry loom with a motorized negative-type let-off is performed manually when the machine is stopped, such adjustment cannot be employed for continuously controlling the pile-to-ground warp ratio. The present invention provides means, however, for automatically adjusting both the distance the rocking bar moves and the tension of the pile warp in order to maintain the pile-to-ground warp ratio substantially constant, thereby producing uniform terry.

DETAILED DESCRIPTION OF THE INVENTION

Figure 1:
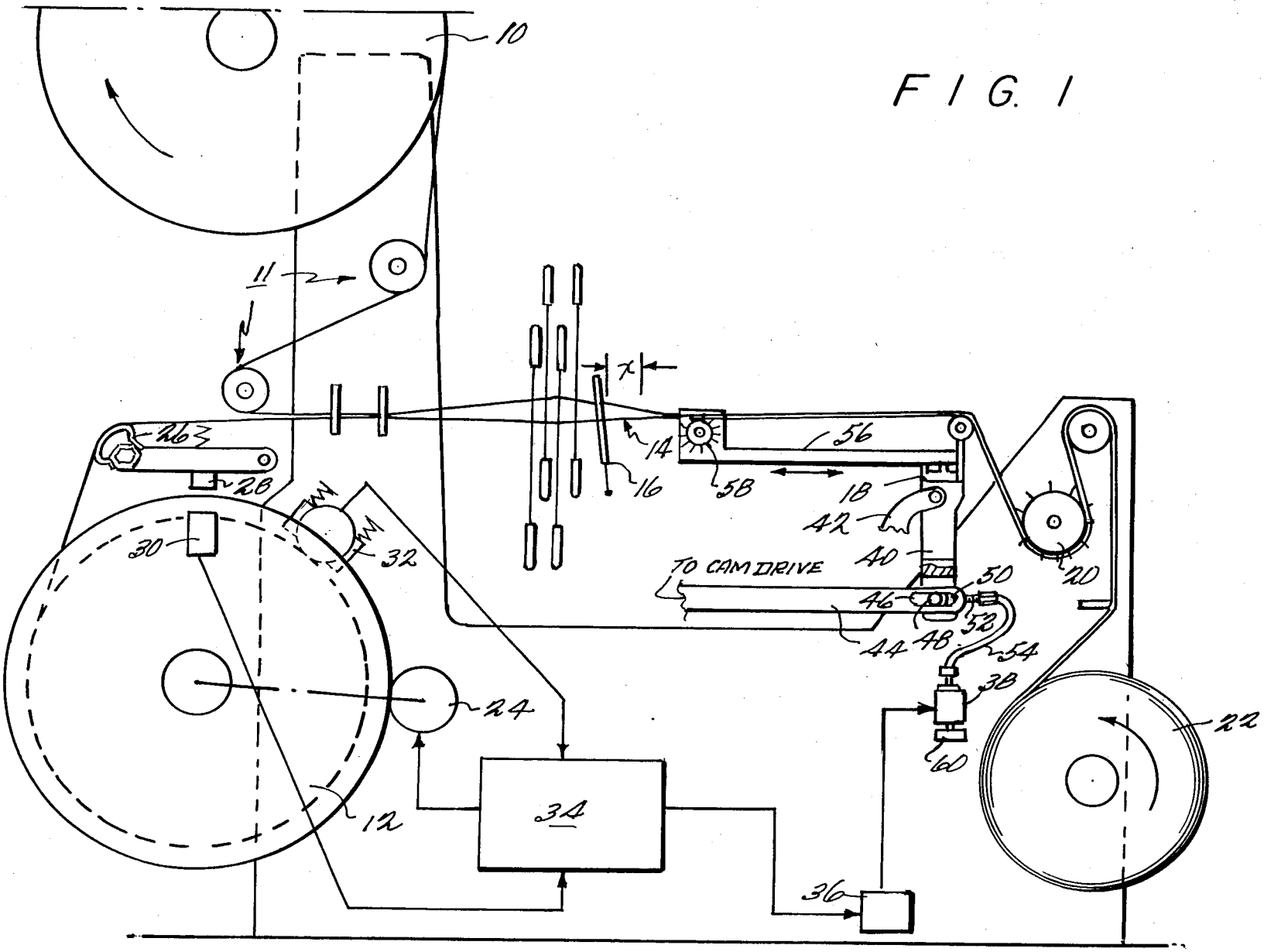
Figure 2:
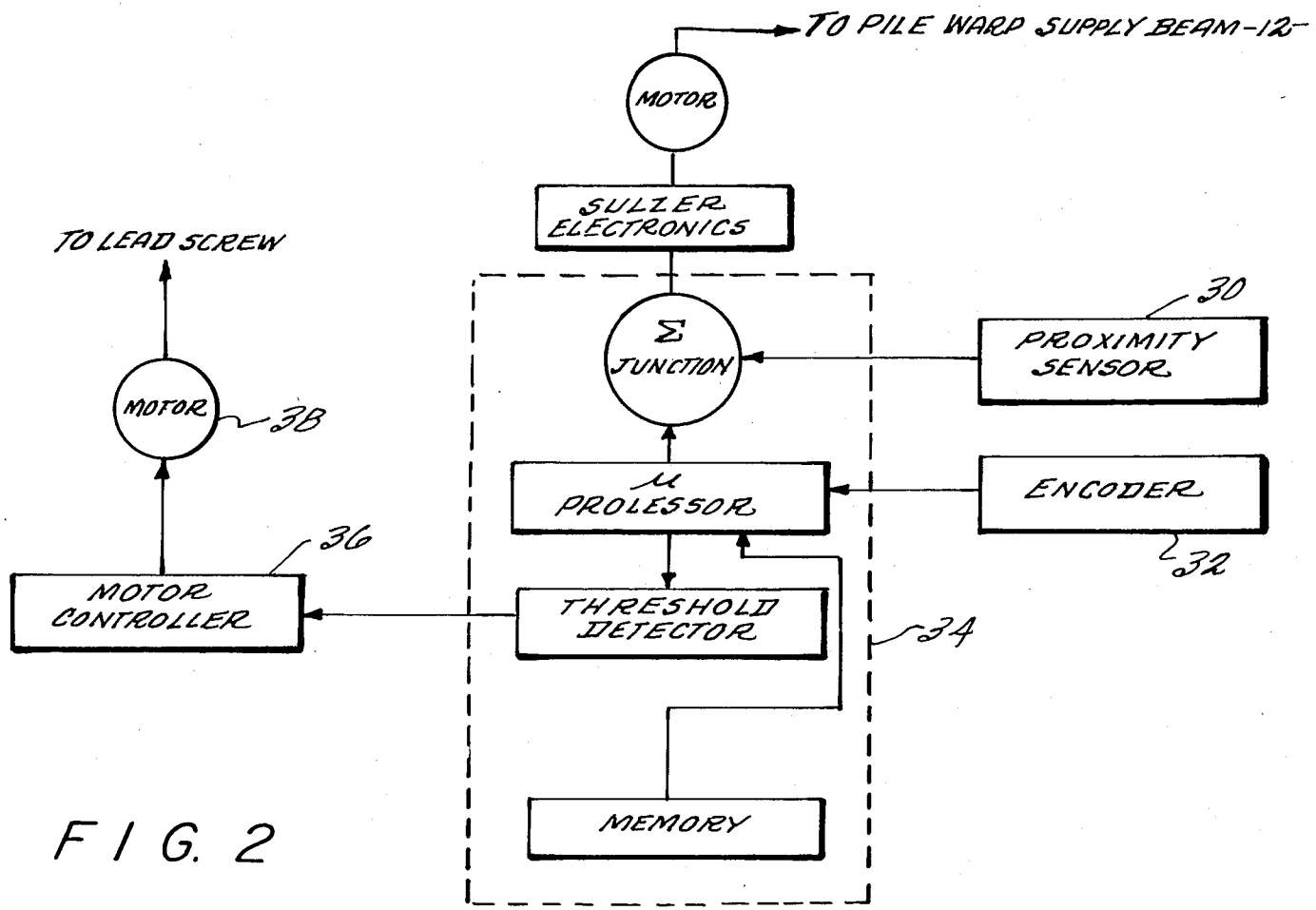

The invention now will be described in greater detail with respect to the accompanying drawings which illustrate a preferred embodiment of the invention, wherein:

FIG. 1 is a side elevational view illustrating the general arrangement of a terry weaving machine according to the present invention; and FIG. 2 is a block diagram of electronic circuitry employed for controlling the pile-to-ground warp ratio.

Referring to FIG. 1, the basic weaving machine illustrated is a well-known and commercially available Sulzer loom which includes a ground warp supply beam 10 and a pile warp supply beam 12. Yarn from each of these beams is directed around beams and past harnesses to the area 14 where weft or filling yarn (not shown) is woven through the warp yarns in the customary fashion. Area 14 lies between an oscillating reed 16 and a rocking bar 18, the latter being reciprocally movable along a path extending in the direction of warp yarn travel. As they move towards bar 18, the reed 16 positively carries the filling yarn to the fell of the cloth being woven. The cloth thereafter moves past a needle-type take-up beam 20 which rotates at constant speed, and then is collected by a final beam 22.

The ground warp yarn is removed continuously from beam 10. The rate of removal is controlled by the take-up beam 20. In the Sulzer machine incorporating the present invention, the ground warp yarn passes over a deflecting and tensioning beam arrangement 11 of the type disclosed, for example, in the aforesaid U.S. Pat. No. 4,122,873. Thus, the amount of warp yarn dispensed from beam 10 is continuous and is a known quantity which remains constant throughout the weaving operation. The pile warp yarn is dispensed from beam 12 in response to signals to the pile warp let-off motor 24.

As the pile warp yarn leaves beam 12, it passes over a tensioning beam 26. Beam 26 is of the type disclosed, for example, in the aforesaid U.S. Pat. No. 3,871,419, the beam being pivotally mounted for deflection. A flag 28 is attached to beam 26, the outer end of the flag being positioned adjacent to a fixed proximity sensor 30 of the type disclosed, for example, in the aforesaid U.S. Pat. No. 4,569,373. When the tension on the pile warp varies, beam 26 deflects, thus altering the distance between the flag 28 and sensor 30. The sensor thereby produces an electrical output signal which is a function of pile warp tension.

An encoder 32 also is operably related to the pile warp yarn as it is discharged from beam 12. The encoder 32 is a conventional device commonly employed in industrial applications to produce an electrical output as a function of rotation imparted to a roller portion of the encoder. An encoder suitable for this purpose is the commercially available Accu-Coder Model 716-S manufactured by Encoder Products Co. of Sandpoint, Id. This type of encoder produces a given number of output pulses for each revolution of its roller. As it is employed as part of the present invention, the encoder roller spring-biased against the pile warp yarn wound on beam 12 producing, as the beam rotates, an electrical signal which accurately indicates the rate of yarn discharge from the beam. This rate is, of course, directly the amount of yarn dispensed from the beam.

The signals from the encoder 32 and sensor 30 are utilized in a manner now to be described in order to maintain a substantially constant pile-to-ground warp ratio.

As illustrated in FIG. 2, the output signal from encoder 32 is directed to circuitry 34 which includes a microprocessor. The circuitry also incorporates appropriate memory which stores information relating both to the amount of ground warp yarn dispensed and programming for the microprocessor. Since delivery of the ground warp yarn is controlled by the constant speed of take-up beam 20, the amount of ground warp being dispensed from beam 10 is a known quantity. Thus, data which accurately represents how much warp yarn the constant speed motor 20 is dispensing from beam 10 can be entered into the memory portion of circuitry 34, together with instructions for causing that data to be inputted to the microprocessor and a calculation to be performed in conjunction with the signal inputted to the microprocessor from encoder 32, the latter signal representing the pile warp yarn being dispensed. With these inputs, the microprocessor continuously computes the pile-to-ground warp ratio occurring as the loom operates. If the ratio departs from a pre-programmed desired level, the microprocessor's output, when combined with that developed by proximity sensor 30, produces a signal which alters the operation of the pile warp let-off motor 24 to perform a limited adjustment to the rate at which pile warp yarn is discharged from beam 12. This is accomplished by applying the microprocessor and sensor outputs to a conventional summation circuit, the output of which is directed to known circuitry ("Sulzer Electronics") found in commercially available Sulzer machines. This circuitry performs the basic timing and control functions necessary for loom operation. As it pertains to the present invention, a further function of the Sulzer Electronics is to control pile warp tension in the manner by which that function is achieved through the operation of the electronic programmed control device described in the aforesaid U.S. Pat. No. 4,569,373. More particularly, the pile warp supply beam 12 is either speeded up or slowed down, in response to changes in the pile warp tension, by varying the control signals to the motor. This causes either an increase in the amount of pile yarn dispensed when the pile-to-ground ratio is too low, or a decrease in the pile yarn dispenser when the ratio is too high. As a result, the tension of the pile warp is maintained constant.

The control of the pile-to-ground warp ratio obtainable by varying just the operation of pile warp let-off motor 24 is limited, however. Accordingly, the present invention provides additional control of large excursions of the ratio by means now to be described.

The circuitry 34 includes conventional threshold detector means for the recognition of error in excess of a predetermined level. When this occurs, the detector's output is directed to a motor controller 36 which in turn is joined to a further motor 38. This motor operates a lead screw arrangement (hereinafter described in detail) associated with rocking bar 18 so as to alter the displacement of bar 18. As a result, the minimum spacing "x" which occurs between the reed 16 and the fell of the cloth being woven is altered. When spacing "x" increases, the height of the pile increases, while a decrease of the spacing "x" results in the pile height decreasing.

The signal from the threshold detector directed to motor controller 36 is of a predetermined interval only. Thus, the adjustment of the rocking bar 18 is incremental. This provides the circuitry 34 with an opportunity to determine whether the adjustment of the displacement of bar 18 has been sufficient to bring the pile-to-ground warp yarn ratio to a level where it can be controlled by the signals generated by sensor 30 and encoder 32. If an error sufficient to produce an output signal from the threshold detector persists after an incremental adjustment of rocking bar 18 occurs, another such adjustment is made. This process is repeated until the desired pile-to-ground warp ratio can be attained solely by the operation of pile warp let-off motor 24.

The mechanical arrangement by which the rocking bar 18 is adjustably displaced is illustrated in FIG. 1. More particularly, bar 18 is secured to the upper end of an arm 40 which is pivotally connected to a stationary support member 42. Arm 40 is forked at its lower end, one portion of the fork being omitted from FIG. 1 for convenience of illustration. A horizontally disposed arm 44 is arranged with one of its ends located within the fork of arm 40. The other end of arm 44 is operatively connected to a cam drive (not shown) which reciprocates the arm after each third pick of the weaving process to permit reed 16 to "beat" the pile warp into the fell of the cloth being woven. The end of arm 44 located within the fork of arm 40 is provided with an elongated slot 46 to receive a pin 48 secured at its ends to the fork. A block 50 also is located within slot 46. The block is joined to a lead screw 52 threaded into arm 44. The lead screw 52 is joined by a flexible drive cable 54 to motor 38. Thus, as motor 38 operates, block 50 is moved along slot 46. Repositioning of the block varies the degree of displacement imparted to the lower end of arm 40 by the uniform horizontal movement of arm 44 produced by the cam drive. The motor 38 has associated with it a rotary limit switch 60 which is set to turn off the motor when the rocking bar 18 is adjusted to its maximum and minimum limits.

The rocking bar 18 is interconnected with a slide 56 which reciprocates horizontally in response to the arcuate movement of bar 18 caused when the lower end of arm 40 is displaced. Slide 56 carries at its outer end a spiked roll 58. The spikes penetrate the cloth produced by the weaving operation. Roll 58 turns only in response to the tension applied to the cloth by the take-up roll 20. Consequently, when the rocking bar 18 is displaced to permit the pile warp to be beaten into the fell, roll 58 supports the fell.

Changes in amount of movement of rocking bar 18 alter the amount of pile warp which is beaten into the fell. Stated otherwise, by increasing the displacement of bar 18 towards the reed 16, a higher pile is developed, while reducing the travel of bar 18 towards the reed lowers the pile height.

Since the electronics employed in the present invention recognize deviations from a desired pile-to-ground warp ratio, it is apparent that the error signals developed also can be used to energize suitable indicators to show when the cloth being produced is not within an acceptable range.

What is claimed is:

1. In a terry weaving machine of the kind including a first supply beam from which pile warp yarn is dispensed under the control of a negative type pile warp let-off motor, a second supply beam from which ground warp yarn continuously is dispensed, a reciprocally operable reed and a rocking bar past which said pile and ground warp yarns are directed, said rocking bar being intermittently operable for displacement from a first position towards said reed to a second position and then returning from said second position to the first position, the invention comprising:

means for sensing the tension on said pile warp yarn to produce a first electrical signal;

means for sensing the rate at which the pile warp yarn is dispensed from the first supply beam to produce a second electrical signal;

circuit means responsive to: said first signal, said second signal, to data representative of the rate at which ground warp yarn is continuously dispensed, and to a pre-programmed desired pile-to-ground warp ratio, to produce first and second output signals, said first output signal being determined by a difference between the desired pile-to-ground warp ratio and an actual pile-to-ground warp ratio calculated by said circuit means from said second electrical signal and said data, and said second output signal occurring when said difference exceeds a threshold level;

means for connecting the first output signal to said pile warp let-off motor to alter the rate at which the pile warp yarn is dispensed; and means responsive to said second output signal for altering the distance between the second position of the rocking bar and said reed to thereby alter the height of terry produced when the rocking bar is in the second position.

2. In a terry weaving machine of the type set forth in claim 1 or 6, the invention further comprising:

a stepper motor operatively connected to the rocking bar to incrementally alter the distance between said second position and the reed.

3. In a terry weaving machine of the type set forth in claim 2, said rocking bar being positioned at one end of an arm pivotally supported between its ends, said stepper motor being operatively connected to the opposite end of said arm to alter the amount of pivotal movement of said arm.

4. In a terry weaving machine of the type set forth in claim 3, wherein the operative connection between the stepper motor and the opposite end of the pivotally supported arm comprises:

a cam-driven arm having an elongated slot therein for receiving a pin joined to the end of said pivotally supported arm;

a block positioned within said slot for engagement with the pin to cause pivotal movement of the pivotally supported arm;

a lead screw joined to the cam-driven arm and to said block; and means for connecting the stepper motor to the lead screw whereby energization of the stepper motor causes the block to be repositioned within the slot.

5. In a terry weaving machine of the type set forth in claim 1, said circuit means comprising:

a microprocessor to which is supplied as inputs: said second electrical signal, said data representative of the rate at which the ground warp yarn is dispensed, and the pre-programmed desired pile-to-ground warp yarn ratio, said microprocessor producing an output which is combined with said first electrical signal to produce said first output signal, said microprocessor output additionally being applied to threshold detector logic to produce said second output signal when the threshold level established by the threshold detector logic is exceeded.

6. In a terry weaving machine of the kind including a first supply beam from which pile warp yarn is dispensed, a second supply beam from which ground warp yarn continuously is dispensed, a reciprocally operable reed and a rocking bar past which said pile and ground warp yarns are directed, said rocking bar being intermittently operable for displacement from a first position towards said reed to a second position and then returning from said second position to the first position, the invention comprising:

means for sensing the rate at which the pile warp yarn is dispensed from the first supply beam to produce a first electrical signal;

circuit means responsive to: said first signal, to data representative of the rate at which ground warp yarn is continuously dispensed, and to a pre-programmed desired pile-to-ground warp ratio, to produce an output signal, said output signal being produced when a difference between the desired pile-to-ground warp ratio and an actual pile-to-ground warp ratio, calculated by said circuit means from said first signal and said data, exceeds a threshold level; and means responsive to said output signal for altering the distance between the second position of the rocking bar and said reed to thereby alter the height of terry produced when the rocking bar is in the second position.

* * * * *